United States Patent [19]

Morse

[11] Patent Number: 4,643,560

[45] Date of Patent: Feb. 17, 1987

[54] APPARATUS AND METHOD FOR SYNCHRONIZING EXPOSURE OF A DOCUMENT ONTO A PHOTOSENSITIVE MEMBER

[75] Inventor: John E. Morse, Rochester, N.Y.

[73] Assignee: Eastman Kodak Company, Rochester, N.Y.

[21] Appl. No.: 802,395

[22] Filed: Nov. 27, 1985

[51] Int. Cl.[4] ..... G03G 15/00

[52] U.S. Cl. ..... 355/3 R; 355/68; 355/16; 355/77

[58] Field of Search ..... 355/3 R, 14 E, 16, 67, 355/68, 77, 8, 69; 430/31

[56] References Cited

U.S. PATENT DOCUMENTS

| | | | |
|---|---|---|---|
| 3,432,231 | 3/1969 | Gardner . | |
| 3,549,254 | 12/1970 | Muri . | |
| 3,754,822 | 8/1973 | Melrose . | |
| 3,985,438 | 10/1976 | Kurita . | |
| 3,995,950 | 12/1976 | Townsend . | |
| 4,025,186 | 5/1977 | Hunt et al. | 355/16 X |
| 4,111,541 | 9/1978 | Townsend . | |
| 4,145,136 | 3/1979 | Takahashi . | |
| 4,459,010 | 7/1984 | Hinton . | |
| 4,589,766 | 5/1986 | Fürsich | 355/77 X |

FOREIGN PATENT DOCUMENTS 0048634 7/1984 European Pat. Off. .

*Primary Examiner*—R. L. Moses

*Attorney, Agent, or Firm*—Norman Rushefsky

[57] ABSTRACT

An electrostatic reproduction machine with a photosensitive member on which latent electrostatic images of an original being reproduced are made following charging of the member. A transparent platen supports the original with one or more lamps being provided to flash illuminate the original resting on the platen. The light image produced is transmitted by an optical system to an image frame of a moving photosensitive member to discharge the same selectively in accordance with the original. A movable optical system is provided to permit the light image to be projected onto and move with the moving photosensitive member to reduce image smear.

The photosensitive member includes a perforation to define the location of the image frame. Exposure of the image frame with illumination of the flash lamps is timed by sensing an image of the perforation at the platen.

11 Claims, 4 Drawing Figures

APPARATUS AND METHOD FOR SYNCHRONIZING EXPOSURE OF A DOCUMENT ONTO A PHOTOSENSITIVE MEMBER

BACKGROUND OF THE INVENTION

1. Field of the Invention

This invention relates to an illumination and exposure system for a reproduction apparatus and method and more particularly to an improvement in the synchronizing of the exposure of a photosensitive member used in such apparatus and method.

2. Brief Description of the Prior Art

Modern high speed electrostatic type copiers or reproduction machines may use flash lamps to illuminate, i.e. expose, the original being copied. Use of this type of lamp is one way of providing the necessary exposure speed for very high speed copying. In these arrangements, the entire original is illuminated by the flash lamps providing what is known to the art as full frame exposure.

Since the originals to be copied may be relatively large, and the entire area must be illuminated fully, flash lamps must generate intense light energy over the span of a few microseconds. To support such illumination intensity in turn requires a very large amount of electrical energy with an attendant large, expensive, capacitance type power supply.

To reduce the intensity of illumination required to be provided by the lamps, it has been proposed to extend the period of illumination of the lamps. Inasmuch as the photosensitive member being exposed is moving during this period while the document is stationary, it has been further proposed to move an optical member so that the image of the original moves with the photosensitive member so as to reduce image smear, see U.S. Pat. No. 4,111,541 to Townsend.

After an electrostatic latent image of the original is formed, it is developed and transferred in register to a copy sheet or other support. In a reproduction apparatus wherein a multicolor reproduction of the original is to be made, the original may be flash exposed through color separation filters onto several separate image frames on a photosensitive web, the frames developed with respective colored toners and the developed images serially transferred in register onto a copy sheet or support. Obviously, registration of the separate colored images on the support is of importance in producing of such reproductions.

A means of registration of images on a photoconductor with transfer to a copy sheet has been described in U.S. Pat. No. 4,477,176 to Russel, wherein a roller is used to retain a copy sheet and move same into transfer relationship with several image frames on the photosensitive member. Timing of this roller is controlled by a logic and control unit which in turn receives timing signals regarding web movement from a timing signal generator that senses regularly spaced perforations on the web.

As indicated in U.S. Pat. No. 4,025,186 to Hunt, Jr. et al, a photosensitive web may be provided with two types of perforations, one comprising a series of closely spaced perforations for providing timing signals and the other identifying frame locations on the web for use in triggering a flash exposure. Where an optical element is to be moved during an exposure, it is desirable to synchronize lens movement with the web and provide triggering of the flash unit in accordance with lens position and web position or for example copy sheet registration, see U.S. Pat. No. 3,995,950 which describes a complex system for timing of flash triggering.

It is an object of this invention to provide a full frame exposure system for electrostatic type reproduction apparatus and methods with simplified and improved means for timing exposure of a photosensitive member with an imaging optical member that is moving.

SUMMARY OF THE INVENTION

In accordance with the invention there is provided in a reproduction apparatus and method wherein an original to be reproduced is supported and exposed by projection through an optical system onto a moving photosensitive member, the improvement comprising:

projecting an image of an indicium, associated with an image area on the photosensitive member, through the optical system and sensing same to time the exposure of the photosensitive member.

BRIEF DESCRIPTION OF THE DRAWINGS

The subsequent description of the preferred embodiment of the present invention refers to the attached drawings wherein.

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
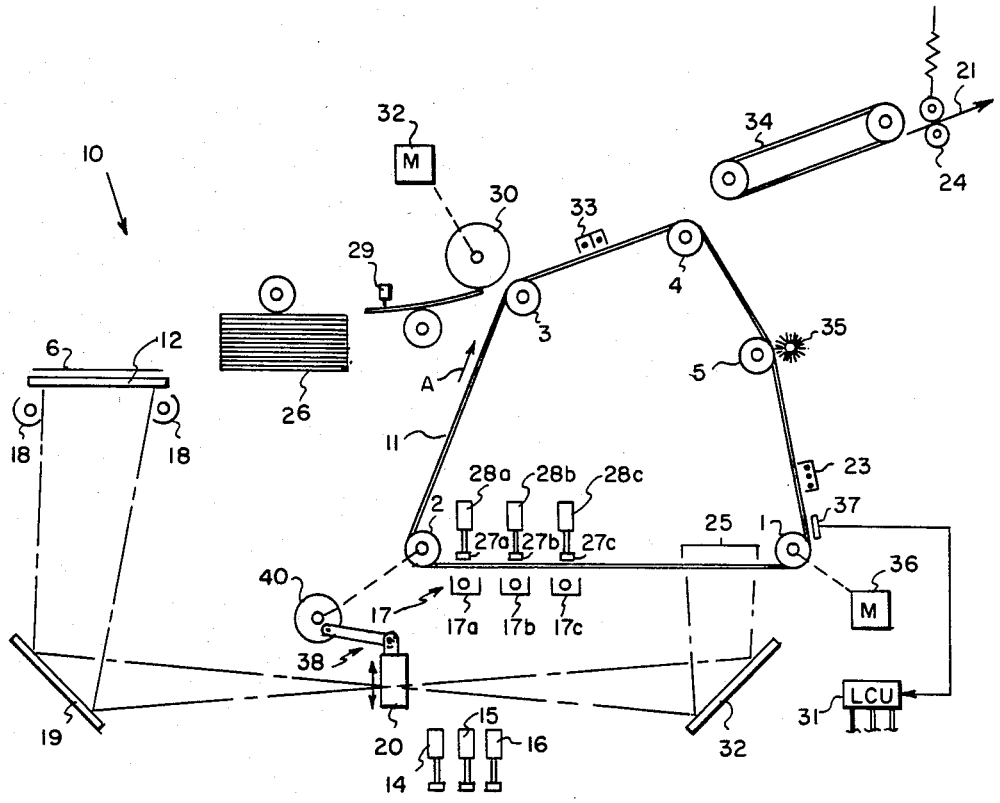
FIG. 1 is a schematic side view of an exemplary reproduction machine of the type adapted to incorporate the exposure timing system of the present invention.

For a general understanding of an electrostatic type reproduction machine or copier in which the invention may be incorporated, reference is made to the drawing FIG. 1 wherein various components of an exemplary color-copier machine, designated generally by the numeral 10, are schematically illustrated. As in most electrostatic type machines, a light image of an original or object 6 such as a document sheet to be copied or reproduced is projected onto the sensitized surface of a photoconductive web, herein in the form of a continuously moving endless belt 11 supported on rollers 1–5, to form an electrostatic latent image thereon. The latent image is then developed as by means of magnetic brushes at a development area 17 to form a xerographic powder image, corresponding to the latent image on web or belt 11. The powder image is then electrostatically transferred to a support surface such as a copy sheet 21 and then permanently fixed by fusing apparatus 24.

Since it is desired to reproduce a multicolor original document sheet in, for example, three colors, the original is illuminated, while supported in a plane on glass platen 12, three times through respective color separation filters 14, 15 and 16, in succession to form three color separation electrostatic latent images thereon. The timing of the flash of xenon flash lamps 18 is controlled as will be described by a logic and control unit (LCU) 31 and related to the travel of the web 11 to expose adjacent, nonoverlapping areas of the web to the images of the document sheet. The lamps flood the document sheet with light and a reflected image of the document sheet is transmitted via mirror 19, lens 20, a color filter and mirror 22 in focus to an area 25 lying in the plane of the web 11. One or more corona charging units, exemplified by corona charger 23, is located upstream of the exposure area 25, and applies a uniform primary electrostatic charge, of say negative polarity, to the web 11 as it passes the charger and before it enters the exposure area. The photoconductive properties of the web cause the primary charge in the exposed areas of the web to be discharged in that portion struck by the exposure light. This forms latent imagewise charge patterns on the web in the exposed areas corresponding to the image on the document sheet. Thereafter, travel of the web then brings the areas bearing the latent images into the development area 17. The development area, as has been noted, has a plurality of magnetic brush development stations, each containing a different color of toner. For example, the toner colors may be cyan, magenta and yellow. Thus, the cyan toner particles may be in station 17*a*, magenta toner particles in station 17*b*, yellow particles in station 17*c*. The toner particles are agitated in the respective developer stations to exhibit a triboelectric charge of opposite polarity to the latent imagewise charge pattern. Backup rollers 27*a*, 27*b* and 27*c*, located on the opposite side of web 11 from the development area, are associated with respective developer stations 17*a*, 17*b* and 17*c*. Actuators 28*a*, 28*b* and 28*c* selectively move respective backup rollers into contact with the web 11 to deflect the web from its travel path into operative engagement with respective magnetic brushes. The charged toner particles of the engaged magnetic brushes are attracted to the oppositely charged latent imagewise pattern to develop the pattern.

The logic and control unit 31 selectively activates an actuator in relation to the passage of an image frame that is to be processed with the respective color toner. If, for example, the first image frame is to be developed with cyan toner and the second and third image frames are to be developed in magenta and yellow respectively then when the image frame containing the image to be developed in cyan reaches the development station, actuator 28*a* moves the backup roller 27*a* to deflect the web so that the latent charge image is developed by attracting cyan toner particles from the station 17*a*. As soon as the image area leaves the effective development area of the station 17*a*, the actuator 28*a* returns the backup roller 27*a* to its nondeflecting position. A similar cycle is accomplished by the logic and control unit 31 for the development of the image sectors containing the information to be developed in magenta and yellow.

The developed image frames must be transferred to a receiver sheet in accurately registered superimposed relation to form a color reproduction of the original document sheet. Apparatus for providing such registered transfer is fully described in U.S. Pat. No. 4,477,176, issued Oct. 16, 1984 in the name of Matthew J. Russel, the contents of which are incorporated herein by this reference. Briefly, this is accomplished by feeding a receiver sheet or support 21, from a supply stack stored in hopper 26, in synchronism with movement of the first image frame so that the receiver sheet engages the web and is registered by sheet registration mechanism 29 with the first image frame. A transfer roller 30 includes a compliant insulating surface thereon and is biased to a potential suitable for transfer of the developed image on the first image sector to the copy sheet 21 and to tack receiver sheet 21 to roller 30. Roller 30 is driven by a stepper motor 32 which receives actuating signals from the LCU 31.

Roller 30 may also be a biased vacuum roller or a roller with sheet clamping mechanisms to clamp the sheet to it.

Continued movement of web 11 and synchronized rotation of roller 30 brings the lead edge of the copy sheet back into transferable relationship with the web as the lead edge of the next toner image arrives at roller 30. The copy sheet remains on the roller 30 during registered transfer of the second developed color image to the sheet and once again is moved into transferable relationship with the web as the lead edge of the next toner image arrives at roller 30. At this point, the bias on roller 30 is reversed to repel sheet 21 away from roller 30 back into contact with web 11. Copy sheet 21 will be carried by web 11 so that the copy sheet is in registration with the image on the third image frame. This image is transferred to the copy sheet by charger 33 that includes a transfer charger and detack charger. The copy sheet is separated from the web and conveyed by vacuum transporter 34 to roller fuser 24 and then to an exit hopper or accessory finishing unit not shown.

While the image is being fixed in fuser 24, the web 11 continues to travel about its path and proceeds through a cleaning area including a cleaning brush 35.

Figure 2:
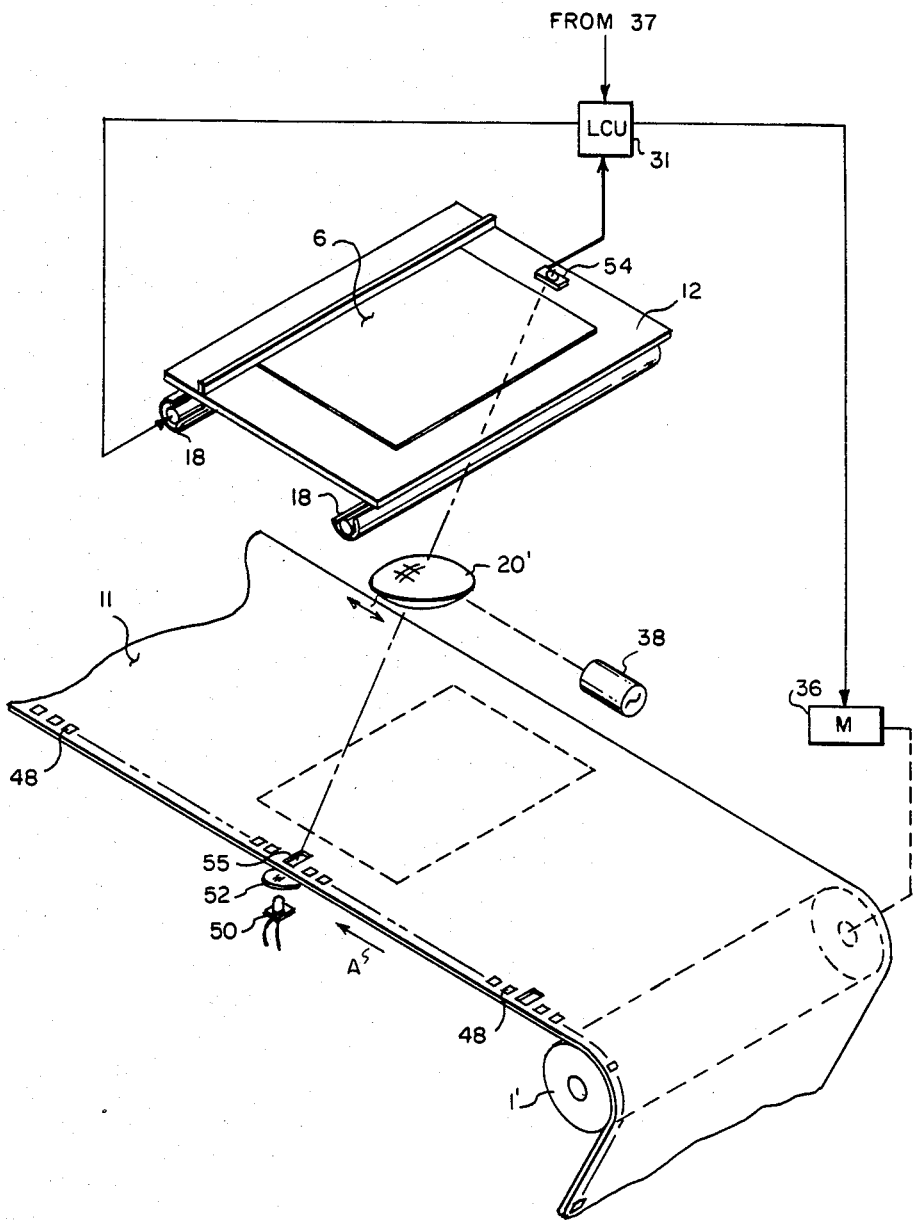
FIG. 2 is a schematic view of a direct optical exposure system illustrating the basic principles of the present invention.

Reference will now also be made to FIG. 2, which for simplicity of description shows a direct exposure system. In FIG. 2, web 11 is driven, in the direction indicated by arrow A, by a constant speed drive motor 36 directly coupled to the web by a suitable drive not shown. During movement of the web, a timing signal generator 37 (see FIG. 1) sensing the closely spaced row of perforations or sprocket holes 48 adjacent the edge of the web generates a series of closely spaced signal pulses which are input to the LCU 31. LCU 31 includes a conventional microprocessor and suitable program memory for controlling the tasks assigned to it. The signals from signal generator 37 are used by the LCU to operate the various components of reproduction machine 10 in an integrated timed manner. For this purpose, the LCU includes a suitable counting mechanism for counting and identifying individual pulses.

As noted, lamps 18 serve to illuminate the platen 12 and any original object 6 thereon. In the prior art, the substantially instantaneous nature of illumination from flash lamps in this environment in effect stops the belt 11 to provide an image free of blur. However, the amount and intensity of light required to uniformly and completely illuminate the entire platen 12 from corner to corner in the space of a few microseconds is extremely large. As a result, flash lamps must have very large and relatively expensive power supplies. Normally, power supplies for this use are of the capacitance type wherein the electric power required to fire the flash lamps is stored on one or more capacitors which are discharged at the instant of flash.

To reduce the intensity of the light required and thus the size and capacity of the lamp power supply, a moving image is generated on belt 11 by the optical system permitting full frame exposure of the original to be made during a time period that is more extended than would otherwise be suitable.

Referring to the schematic shown in FIG. 2, the optical system comprises a lens 20' adapted to transmit light image rays of the original 6 onto the moving photoconductive web 11 at exposure station 25. Lens 20' is suitably supported in a track (not shown) for slidable back and forth movement in a direction substantially paralleling the path of movement of web 11 through the exposure station. A reciprocating lens-driving means 38 such as an eccentric crank and connecting rod arrangement (see FIG. 1) are provided and coupled to the lens to move the lens back and forth along the straight track so that the lens in FIG. 2 is moved parallel to the plane of the web and is at all times equidistant from this plane. The crank may be carried on a flywheel 40 which is drivingly connected for example to gearing (not shown) driven by the sprocket holes 38 in the web.

The drive means is of the type adapted to rotate the flywheel through one or more revolutions for each image frame. During rotation, the connecting rod drives lens 20' first from a start position to a first terminal position in a direction of movement opposite to that of movement of the web 11. Then the lens is driven back to the start position and continues to move in the direction of web movement so that the lens now moves to a second terminal position. The lens then is driven back to the start position. The start position of the lens comprises a position where it is centered on the optical axis of the exposure system. The driving arrangement to the lens may be such that, during rotation of the flywheel, lens 20' is moved during the exposure at about one-half ($\frac{1}{2}$) the speed of web 11 presuming a 1:1 object-image size ratio. This minimizes blurring or distortion of the images. The timing for movement of the lens is such that it returns to its start position at a time sufficient to allow a "fresh" surface of the web to reach the exposure station. Normally, provision is made here for inclusion of any spacing between adjoining images.

Figure 3A:
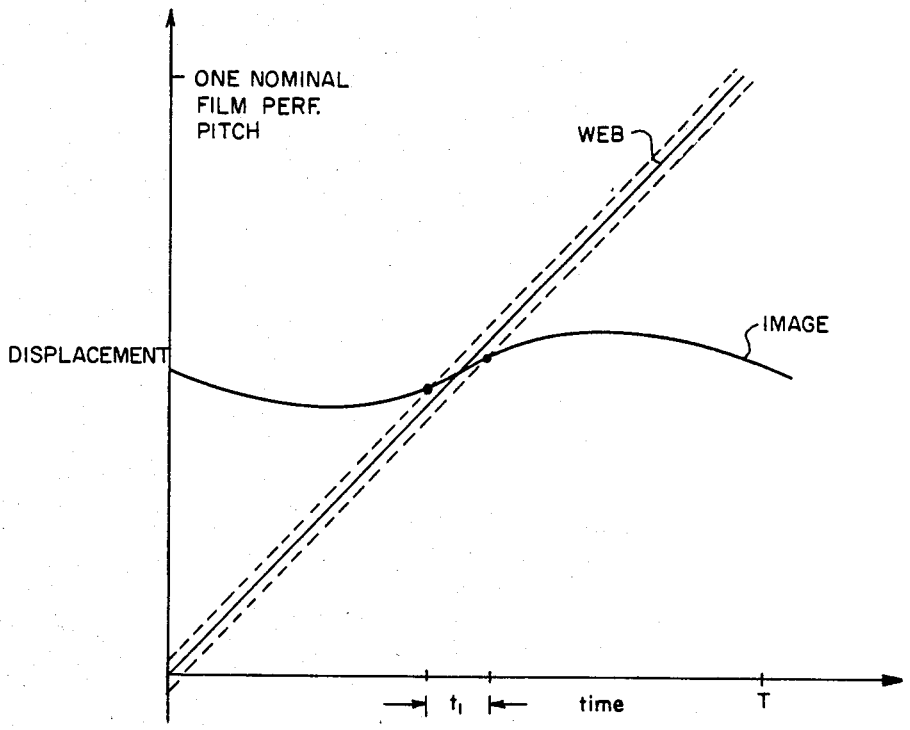
FIGS. 3*a* and 3*b* are graphs illustrating lens image displacement and velocity relationships during a period of movement of the photosensitive member.
Figure 3B:
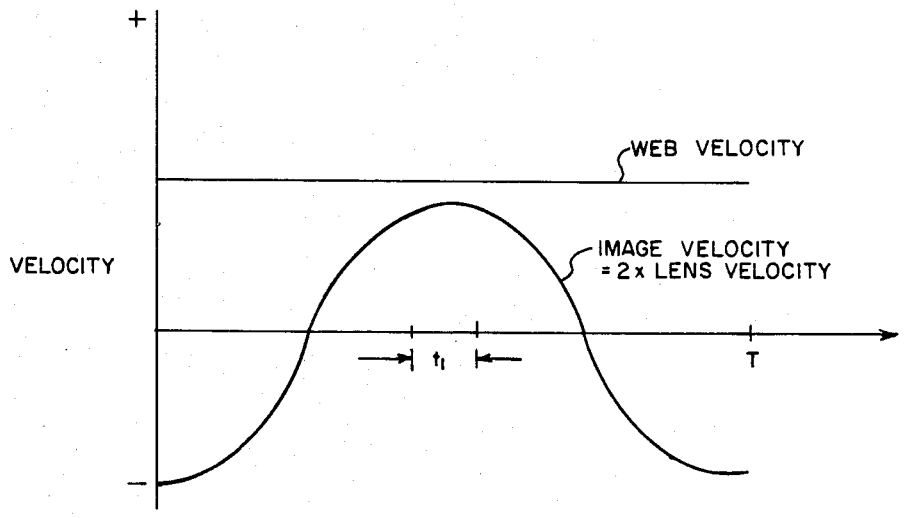

In order to insure synchronization or timing between lens position and frame position, the preferred embodiment of the invention provides for imaging of the image frame perforation, using the exposure optics, upon a light sensing device located at the object plane. In this regard, a light source 50 such as a lamp which may include a small reflector, not shown, is located proximate the web and positioned so that illumination therefrom will be blocked by the web unless a frame perforation 55 directly overlies the lamp. A condenser lens 52 may be positioned between the lamp and the web. The lamp thus cooperates with the image frame perforation so that an image of the frame perforation may be focused by the exposure lens 20' onto a photocell or sensor 54 located on the platen 12 or object plane or its optical equivalent over some effective distance of travel of the film 11. With reference now to FIGS. 3*a* and 3*b* during the period, T, of sinusoidal oscillation of the lens 20' and movement of one perforation a nominal pitch distance there is a small time window, $t_1$, wherein the perforation is likely to overlie the LED. This time window is created by the variation of perforation locations from their respective nominal positions. In FIG. 3*a* the straight line representing web displacement represents displacement of a nominally placed perforation. The dashed lines running parallel to this line represent an envelope within which lines representing actual perforation displacement will be located. The intersection of this envelope with the displacement curve of the lens image defines the time window $t_1$. During this time window $t_1$ the velocity of the image formed by the lens 20' is slightly less than the velocity of the web. In the discussion with regard to FIGS. 3*a* and 3*b*, the velocity and displacement amounts for the image are twice that of the lens 20' due to the two-to-one relationship between image motion at the photoconductor plane and corresponding lens motion. That is, for each unit of lens movement, the image of the document at the photoconductor plane will move two units. If the image frame perforations were each exactly placed on the web in accordance with their nominal pitch dimension, a flash would be commenced or timed at the center of this time window or when the lens is centered on the optical axis of the exposure system. However, there may be small errors in placement of the perforation due to tolerances, etc. during the production thereof. Such perforation will be detected at some point in this small window period, $t_1$, because an image thereof scans across the photocell at a velocity equal to the difference in velocity between the image formed by the lens and the photoconductor. While it is indicated in FIG. 3*b* that the velocity of the document image is less than the photoconductor, a design employing a document image velocity that is slightly greater than the photoconductor during this period is also suitable, the important factor being a relative movement is provided between the image of the image frame perforation 55 and the sensor 54 so that the image of the image frame perforation scans across the sensor located at the object plane or its equivalent optical location. A preferred sensor which may be used comprises two large photodiodes in a bi-cell configuration such as that disclosed in U.S. application Ser. No. 795,563 filed on Nov. 6, 1985 in the names of Phillip W. Pearce and James P. Shipkowski, and entitled "Apparatus and Method for Detecting A Perforation On A Web," the contents of which are incorporated herein. As disclosed in that application, the photodiodes lie in the direction of web travel. As the perforation begins to pass between an LED source and the bi-cell, light from the LED illuminates one photodiode but not the other. As the perforation becomes centered over the photodiodes, both photodiodes receive equal amounts of illumination and a signal is generated indicating location of the perforation. The circuit for detecting the perforation includes a first comparator circuit for comparing the outputs of the photodiodes with each other and providing a signal when they are equal, a second comparator circuit for comparing the sum of the two outputs with a peak detector to arm the first comparator circuit and to prevent false triggering, and a third comparator circuit which compares the output of the peak detector with a reference voltage to shut down the system when an insufficient amount of light is being received by the photodiodes.

Although there is a difference in velocity between the image of the original upon the photoconductor, and the photoconductor this difference is significantly less than that where no lens movement is provided for. Thus, less image smear is introduced into an exposure for equivalent exposure times or lower intensity exposures may be provided to obtain longer duration exposures with equivalent amounts of acceptable image smear.

When the image of the image frame perforation is detected at the photosensor 54, a voltage or current change is detectable by the LCU 31 and this change or signal is used by the LCU to time or commence the exposure by providing a signal to illuminate lamps 18 to expose an image of the document sheet 6 onto the image frame of the photoconductor while the photoconductor continues to move.

The invention has been described in detail with particular reference to preferred embodiments thereof, but it will be understood that variations and modifications can be effected within the spirit and scope of the invention.

I claim:

1. In a reproduction apparatus for producing one or more copies of an original the apparatus including means for supporting the original in a plane, a movable photosensitive member having indicium thereon for identifying a location upon which an image is to be located, an exposure station including means for exposing said member to a light image of the original, said exposing means including projecting means forming an optical path for transmitting a full frame light image of the original to the photosensitive member at the exposure station to image same on the photosensitive member, the projecting means including means to displace the optical path and the full frame image formed by the projecting means during the exposure of the photosensitive member in substantial parallelism with the movement of the photosensitive member at said exposure station; and the improvement comprising:

light sensor means located on the object plane or its optical equivalent;

means for imaging the indicium on the photosensitive member onto the light sensor through the projecting means; and means responsive to the sensing of the image of the indicium by the light sensor for use in timing the exposure.

2. The apparatus of claim 1 and including means for moving the photosensitive member at a velocity different from that of the velocity of displacement of the full frame image formed by the projecting means so that there is relative movement between the two.

3. The apparatus of claim 2 and wherein the projecting means includes a lens; and the means to displace the optical path comprises means for moving the lens.

4. The apparatus of claim 3 and wherein the photosensitive member is a photoconductor.

5. In a reproduction apparatus including means for supporting an original to be reproduced, means comprising a photosensitive medium for producing an image, means defining an indicium for identifying a location upon which an image is to be located on the photosensitive medium, optical means for projecting an image of the original onto the photosensitive medium at an exposure station, means for moving the photosensitive medium along a predetermined path that includes said exposure station, imaging means cooperating with the optical means for projecting an image of the original onto the photosensitive medium at the exposure station; the improvement comprising:

means for projecting an image of the indicium through the optical means;

and means for sensing the image of the indicium and for signaling the imaging means to commence an exposure.

6. In a method for reproducing an original, the steps of exposing an image of the original through an optical system onto a moving photosensitive member, during the exposure moving one or more elements of the optical system to displace the image in substantial parallelism with the movement of the photosensitive member and the improvement which comprises:

projecting an image of an indicium associated with an image area on the photosensitive member, through the optical system and sensing same to time the exposure of the photosensitive member.

7. The method of claim 6 and wherein the original is supported in a plane and wherein the image of the indicium is sensed by a sensor located in the plane or its optical equivalent.

8. The method of claim 6 and wherein the photosensitive member is a photoconductor and wherein prior to the exposure step the photosensitive member is provided with a primary electrostatic charge and in the exposure step the electrostatic charge is modulated with image information from the original to form an electrostatic image.

9. The method of claim 8 and wherein the electrostatic image is developed with electroscopic particles and transferred to a receiver to form a reproduction on the receiver.

10. The method of claim 6 and wherein the image of the indicium scans across a sensor.

11. In a method for reproducing an original, the steps of moving an indicium used in identifying a location on a moving photosensitive member upon which an image of an original is to be projected, projecting an image of the original through an optical system onto the photosensitive member at the exposure station; the improvement comprising:

projecting an image of the indicium through the optical means; and sensing the image of the indicium and signaling the imaging means to commence an exposure.

* * * * *